US008835886B2

(12) United States Patent
Vu et al.

(10) Patent No.: US 8,835,886 B2
(45) Date of Patent: Sep. 16, 2014

(54) UV NAIL LAMP

(75) Inventors: Thong Vu, Vista, CA (US); David Valia, San Diego, CA (US)

(73) Assignee: Revlon Consumer Products Corporation, New York, NY (US)

( * ) Notice: Subject to any disclaimer, the term of this patent is extended or adjusted under 35 U.S.C. 154(b) by 41 days.

(21) Appl. No.: 13/012,618

(22) Filed: Jan. 24, 2011

(65) Prior Publication Data

US 2012/0187311 A1 Jul. 26, 2012

(51) Int. Cl.

| | |
|---|---|
| ***A45D 29/00*** | (2006.01) |
| ***G21K 5/08*** | (2006.01) |
| *A45D 29/22* | (2006.01) |

(52) U.S. Cl.

CPC ..... *A45D 29/001* (2013.01); *A45D 29/22* (2013.01); *A45D 29/00* (2013.01)

USPC ..... 250/494.1; 250/504 R; 250/504 H; 34/275

(58) Field of Classification Search

USPC ..... 250/493.1, 494.1, 496.1, 504 R, 504 H; 34/275

See application file for complete search history.

(56) References Cited

U.S. PATENT DOCUMENTS

| | | | | |
|---|---|---|---|---|
| 2,262,274 | A * | 11/1941 | Fingerlin | 34/202 |
| 2,349,509 | A | 4/1944 | Marano | |
| 4,754,769 | A * | 7/1988 | Flynn | 132/73.5 |
| 4,979,523 | A | 12/1990 | Grimm | |
| 4,987,310 | A * | 1/1991 | Oppawsky et al. | 250/492.1 |
| 4,988,883 | A | 1/1991 | Oppawsky | |
| 5,130,553 | A | 7/1992 | Amoh | |
| 5,249,367 | A * | 10/1993 | Nafziger et al. | 34/275 |
| 6,518,583 | B1 * | 2/2003 | Hennig | 250/504 R |
| 6,762,425 | B1 * | 7/2004 | Strait | 250/504 R |
| 6,762,452 | B2 * | 7/2004 | Nastasi et al. | 257/316 |
| 7,118,589 | B2 | 10/2006 | Vlahos | |
| 2008/0289644 | A1 * | 11/2008 | Bernecker | 132/73.5 |
| 2009/0160923 | A1 | 6/2009 | Custer | |

OTHER PUBLICATIONS

Photographs of Light Elegance Lamp (2007).*
Photographs of Creative Nail Design Brisa Lamp (2009).*
"Light Elegance 100 Volt 9-Watt Easy Cure Lamp" www.lightelegance.com [Brochure] (2007) (admitted prior art).
Photographs of Creative Nail Design Brisa Lamp (2009) (admitted prior art).
Photographs of Light Elegance Lamp (2007) (admitted prior art).

* cited by examiner

*Primary Examiner* — Jack Berman
*Assistant Examiner* — David E Smith
(74) *Attorney, Agent, or Firm* — Revlon Consumer Products Corporation

(57) ABSTRACT

A lamp includes: a housing; a platform supported by the housing; a left light source disposed on a left side of the lamp; a right light source disposed on a right side of the lamp; a first top light source disposed at least partially above the platform, wherein; the left and right sources extend closer to a front of the lamp than the first top light source; and a space between the platform and the; light sources; to simultaneously receive therein five nails of all five digits of a hand or foot of a user. The positions of the sources and platform may be designed so as to provide substantially uniform light flux to all five nails so as to synchronously and uniformly cure light-curable nail gel or acrylic on the user's nails.

2 Claims, 10 Drawing Sheets

UV NAIL LAMP

BACKGROUND

1. Field of the Invention

The present invention is generally related to an ultraviolet (UV) nail lamp, which has a light source and platform configuration that are designed to cure UV-curable gel or acrylic on a user's nails.

2. Description of Related Art

Conventional nail coatings may be classified into two categories: nail polishes; also known as lacquers, varnish or enamels and artificial nails; also known as gels or acrylics. Nail polishes typically comprise various solid components which are dissolved and/or suspended in non-reactive solvents. Upon application and drying, the solids deposit on the nail surface as a clear, translucent or colored film. Typically, nail polishes are easily scratched and are easily removable with solvent, usually within one minute and if not removed as described, will chip or peel from the natural nail in one to five days.

Conventional artificial nails are comprised of chemically reactive monomers, and/or oligomers, in combination with reactive or non-reactive polymers to create systems which are typically 100% solids and do not require non-reactive solvents. Upon pre-mixing and subsequent application to the nail plate, or application and exposure to UV radiation, a chemical reaction ensues resulting in the formation of long lasting, highly durable cross-linked thermoset nail coating that is difficult to remove. Artificial nails may possess greatly enhanced adhesion, durability, as well as scratch and solvent resistance when compared to nail polishes. However, because of these inherent properties, such thermosets are much harder to remove, should the consumer so desire. Removal typically requires soaking in non-reactive solvents for 30-90 minutes (for acrylics and currently available "soakable gels"; it may take more than 90 minutes if ever to remove traditional UV nail gels by solvent) and typically may also require heavily abrading the surface or scraping with a wooden or metal probe to assist the removal process.

After applying UV-curable gel or acrylic to a user's nails (e.g., finger nails, toe nails), the user places one or more of their nails under a UV nail lamp. The UV nail lamp emits UV light that UV cures the gel or acrylic.

SUMMARY OF EMBODIMENTS

Current commercially available UV nail lamps can be applied to fewer than five nails at a time. This is partially due to the configuration of the fingers and toes of a human user. For example, in a human user, the index, middle, and ring fingers are close to each other in length (less than ¾ inches apart). By contrast, the little (pinky) finger is approximately more than 1 inch shorter than the nail of the middle finger, and the thumb is about 2 inches shorter than the middle figure. Thus, the nails of these fingers are located at different locations relative to one another. Moreover, the thumb nail is angled at about 60° from a horizontal orientation in which the other four nails are disposed. A similar discrepancy also exists for a human's toes. Conventional nail lamps are not designed to account for the anatomical configuration of a human hand or foot and/or are not designed to properly accommodate all five nails of the user's hand or foot. Such a challenge is compounded even further by the different configurations of the right and left hands (or feet).

Moreover, because of the configuration of the fingers (and toes), the nails thereof are exposed to different intensities/ fluxes of the UV output in conventional lamps. This is because the UV output from a UV light bulb can vary with the location of the bulb. The center of the bulb typically has the highest UV output and the end of the bulb typically has less UV output (e.g., half of the output of the middle of the bulb according to various conventional bulbs). In general, the UV energy decreases gradually from the center point to either end of the bulb. The distance from a bulb to a nail also affects the UV output received by the nail. In general, the farther away from the bulb the nail is, the less UV output it will receive. The effect of the distance is compounded further by the fact that the thickness of fingers is normally much less than that of toes, and thus a conventional lamp for finger nails may not be suitable for toe nails. Finally, light bulbs, particularly UV light bulbs, can be expensive. Thus, there is an economical incentive to minimize the number of light bulbs used in the lamp.

Therefore, a need exists to improve the design of the conventional nail lamp so that the lamp can accommodate all of the nails at once. There is also a need for a lamp that can accommodate both the right and left hand and both a hand and a foot with similar efficacy. There is also a need for a UV lamp that simultaneously provides substantially uniform UV light intensity to all five nails on the hand or foot of the user.

In one embodiment, a nail lamp is provided, the lamp comprising: a housing; an upwardly facing platform supported by the housing; a plurality of light sources supported by the housing, the plurality of light sources including a left light source disposed on a left side of the lamp, a right light source disposed on a right side of the lamp, and a first top light source disposed at least partially above the platform, wherein at least one of the left and right sources extends closer to a front of the lamp than the first top light source does; and a space between the platform and the plurality of light sources, the space being sized and positioned to simultaneously receive therein five nails of all five digits of a hand or foot of a user so as to expose each of the five nails to at least one of the plurality of light sources.

An alternative embodiment describes a method of curing UV-curable nail product using a nail curing lamp comprising a housing, an upwardly facing platform supported by the housing, and a plurality of light sources supported by the housing, the plurality of UV light sources including a left UV light source disposed on a left side of the lamp, a right UV light source disposed on a right side of the lamp, and at least one top UV light source disposed at least partially above the platform, wherein at least one of the left and right UV sources extends closer to a front of the lamp than all of the at least one first top UV light sources. The method comprises: receiving all five nails of all five digits of a hand or foot of a user in a space between the platform and the plurality of light sources, said five nails having thereon uncured UV-curable nail product; and simultaneously exposing the UV-curable nail product on all five said nails to UV light from the plurality of UV light sources, wherein said exposing UV-cures the nail product on all five said nails.

These and other aspects of various embodiments of the present invention, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. In one embodiment of the invention, the structural components illustrated herein are drawn to scale. It is to be expressly understood, however, that the drawings are for the purpose of illustration and description only and are not intended as a definition of the limits of the invention. In addition, it should be appreciated that structural features shown or described in any one embodiment herein can be used in other embodiments as well. As used in the specification and in the claims, the singular form of "a," "an," and "the" include plural referents unless the context clearly dictates otherwise.

BRIEF DESCRIPTION OF THE DRAWINGS

For a better understanding of the embodiments of the present invention, as well as other objects and further features thereof, reference is made to the following description, which is to be used in conjunction with the accompanying drawings, where.

DETAILED DESCRIPTION OF EXEMPLARY EMBODIMENTS

Figure 1:
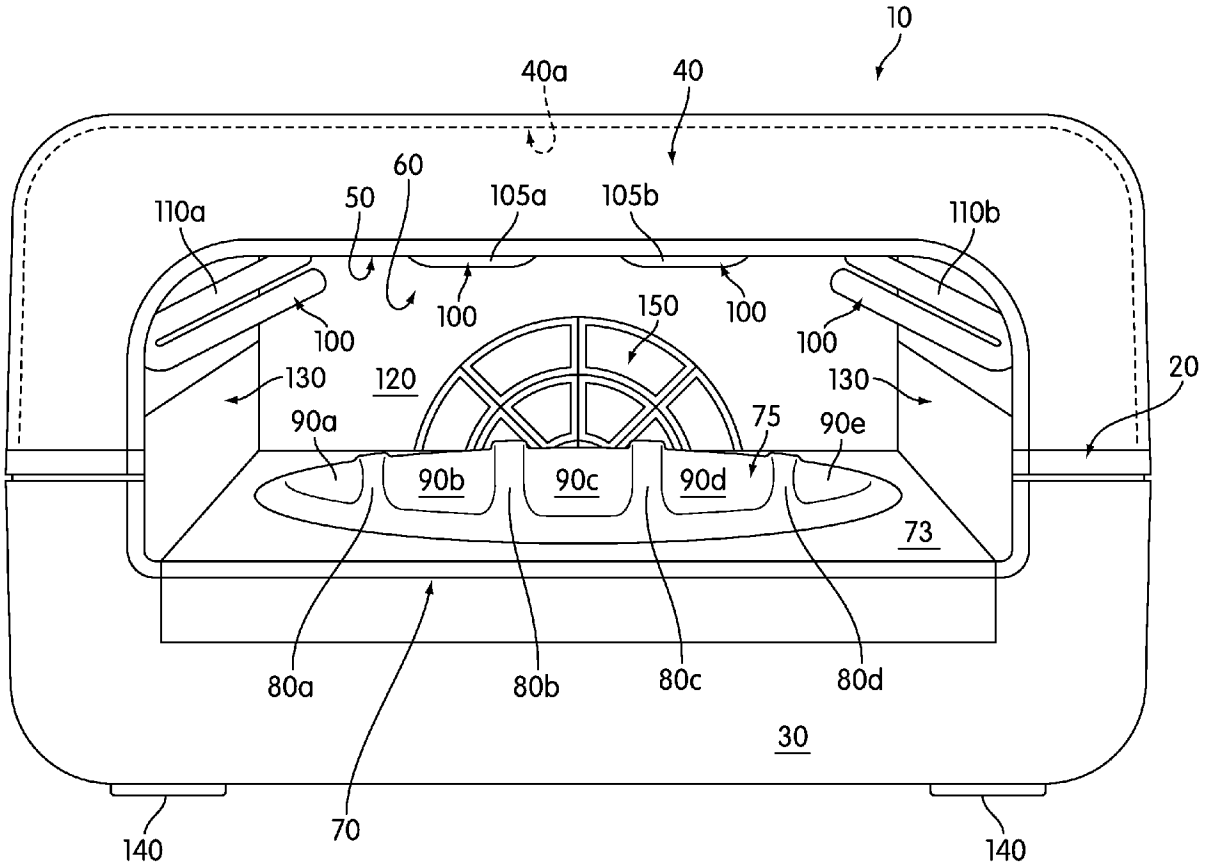
FIG. 1 is a front view of a lamp according to an embodiment of the present invention.

Depicted in FIG. 1 is a front view of a nail lamp 10. The nail lamp 10 includes a housing 20 that is configured to support components of the nail lamp 10, as described in greater detail below. The housing 20 may be of any suitable construction or configuration, including but not limited to comprising plastic, metal, alloys, ceramic, polymer, carbon fibers, or combinations thereof. While in some embodiments the housing 20 may be a unitary structure, in the illustrated embodiment the housing 20 includes a base 30, and a cover 40. Formed in a side of the housing 20 is an entry aperture 50. The entry aperture 50 may be generally sized and positioned such that a user of nail lamp 10 may place a hand or a foot at least partially into a space 60 formed between components of the nail lamp 10, generally surrounded by the base 30 and the cover 40. In the illustrated embodiment, the entry aperture 50 is partially formed in the front side of the housing, partially in the base 30, and partially in the cover 40.

As shown in the figure, at the bottom of the space 60, and supported by the base 30 is a support platform 70. The support platform 70 may be configured to support the palm of a hand or the sole of a foot placed thereon, so that nails on the hand or foot are directed upwardly towards the cover 40, and away from the support platform 70. In an embodiment, the support platform 70 may be removable from the housing 20, and separate support platforms 70 may be provided for each of the hand or the foot. In an embodiment the support platform 70 for the feet may be of a thinner thickness than that of the support platform 70 for the hands, so as to provide a greater volume in the space 60 to accommodate the feet. In an embodiment, the support platform 70 may selectively retract into the base 30, again allowing the volume of the space 60 to change to better accommodate the feet of a user. In an embodiment, such as that illustrated, a top surface 73 of the support platform 70 may contain a spacer platform 75. In an embodiment, the spacer platform 75 may contain a plurality of spacers 80 (individually spacers 80*a*-80*d*) that are sized and positioned to separate from one another the digits (i.e. the fingers or toes) of the hands or feet of a user of the nail lamp 10, which help to properly position the user's digits. Defined by the plurality of spacers 80 are a plurality of digit channels 90 (individually digit channels 90*a*-90*e*), spaced appropriately to receive each of the separated digits. In embodiments wherein there are separate support platforms 70 for each of the hands and feet, the shape and configuration of the plurality of spacers 80 and/or the shape and configuration of plurality of digit channels 90 may be customized for the hands or the feet on different ones of the support platforms 70. In some embodiments, the spacer platform 75 may contain a material or materials that cushion, provide cooling, or otherwise provide comfort for contacting portions of the digits of the user.

As shown in FIGS. 1, 3, 4, 7, 8, and 9, nail lamp 10 includes a plurality of light bulbs 100. As used herein, "light bulb" is defined broadly to include any light source or light-generating mechanism. A pair of top light bulbs 105 (individually top left light bulb 105*a* and top right light bulb 105*b*) extend across the top of the space 60 with their longitudinally elongated axes extending generally towards a plane defined by the entry aperture 50, are. Furthermore, extending generally along the top left and the top right of the space 60, as viewed from the entry aperture 50, are a pair of side light bulbs 110 (individually left side light bulb 110*a* and right side light bulb 110*b*). The mounting and orientation of the light bulbs 100 are described in greater detail below. Each of the top light bulbs 105 and the side light bulbs 110 may be of any suitable construction and configuration, and may vary across embodiments. For example, in various embodiments the top light bulbs 105 and the side light bulbs 110 can be UV light bulbs, fluorescent light bulbs, infrared light bulbs, or candescent light bulbs. In an embodiment, the top light bulbs 105 and the side light bulbs 110 may have a shape of a tube or of a combination of tubes. In some embodiments, the top light bulbs 105 and the side light bulbs 110 may include Light Emitting Diodes (LEDs). In an embodiment, the top light bulbs 105 and the side light bulbs 110 may comprise an array of bulbs (including but not limited to an array of LEDs) which may generally be disposed to have a shape (e.g., physically or in terms of light output) similar to the cross section of the light bulbs 100 otherwise described herein. In an embodiment, the light bulbs 100 may be elongated and may have a length of between about 100 mm about 150 mm In one such embodiment, the length of each of the top light bulbs 105 and the side light bulbs 110 may be between approximately 125 mm and 130 mm. In an embodiment, the top light bulbs 105 and the side light bulbs 110 may be configured to emit a wavelength of light or other electromagnetic radiation configured to photochemically cure gel or acrylic applied to the finger or toe nails of the hands or feet placed in the space 60.

In an embodiment, one or more surfaces surrounding the space 60 may be configured to assist in the distribution of light from the top light bulbs 105 and/or the side light bulbs 110. For example, in an embodiment the top surface 73 of the support platform 70 may contain or otherwise be covered in a reflective material configured to reflect the emitted light. In an embodiment, the spacer platform 75 might not be covered in the reflective material, as the presence of the hand or digits contacting the spacer platform 75 would prevent the light from being reflected therefrom. In some embodiments an inside of the back wall 120 and/or right and left sidewalls 130 of the housing 20 (including portions associated with the base 30 and/or portions associated with the cover 40) may also comprise or otherwise be covered in reflective material facing inward towards the space 60. Furthermore, in an embodiment the underside 40*a* of the top of cover 40 facing inward towards the space 60 may comprise or otherwise be covered in reflective material. The reflective material may be of any suitable construction or configuration, including but not limited to comprising one or more mirrors. In some embodiments, the one or more mirrors may be of any suitable construction or configuration, including but not limited to comprising mirrored glass, mirrored metal, and/or mirrored plastic.

In some embodiments, the nail lamp 10 may include features configured to improve airflow in and around the nail lamp 10. For example, in the embodiment of FIG. 1, the base 30 may include a plurality of base supports 140 configured to raise the base 30 off of a support surface (i.e. the floor or a table). The presence of the base supports 140 may allow air to flow underneath the base 30, which may improve dissipation of heat from the base 30, which may be generated from the top light bulbs 105 and the side light bulbs 110, or from other electrical components of the nail lamp 10. The base supports 140 may be of any suitable construction or configuration, including for example, being legs or footpads which may provide a level foundation for the base 30. In an embodiment the base supports 140 may comprise a material at ends thereof, such as an elastic material (i.e. a rubber, a polymer, or a foam) which may provide a cushioning or scratch-resistant effect against the support surface. As further shown in FIG. 1, a fan 150 may be provided in the nail lamp 10. The fan 150 may in various embodiments be configured to either blow cooler air into the space 60, or pull hotter air out of the space 60. In an embodiment the fan 150 may be positioned to face entry aperture 50, so that entry aperture 50 forms a direct entry or exit vent for the air being moved by the fan 150.

Figure 2:
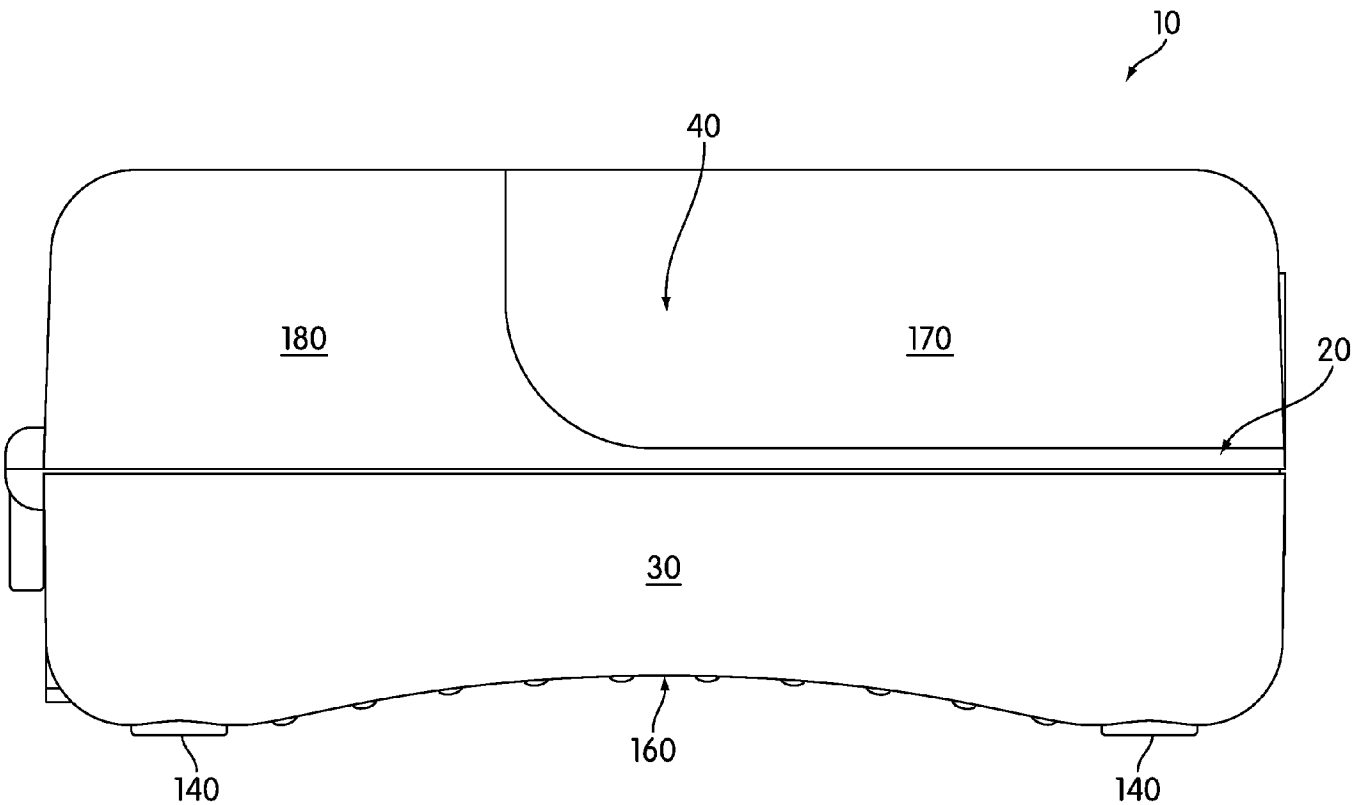
FIG. 2 is a left side view of the lamp of FIG. 1, a right side view being a mirror image thereof.
Figure 3:
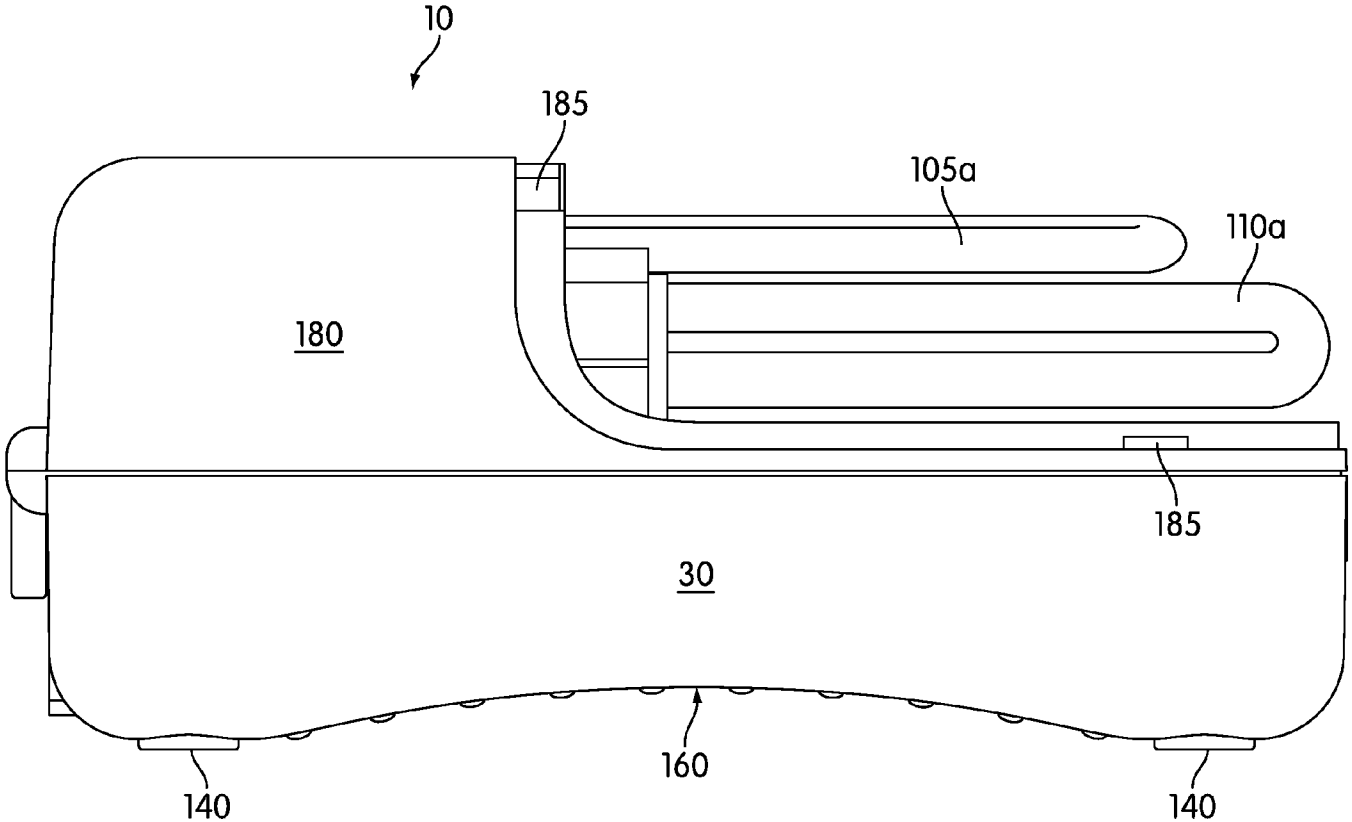
FIG. 3 is a partial left side view of the lamp of FIG. 1, with a cover removed.

Turning to FIG. 2, a left side view of the nail lamp 10 is depicted. In an embodiment, the right side view of the nail lamp 10 may be a mirror image of the view of FIG. 2. In the side view, additional ones of the base supports 140 may be seen, such that the nail lamp 10 is supported above the support surface at both the front and rear of the base 30. Also shown in the side view is a curve 160 to the base 30, which may be provided to further promote air flow underneath the nail lamp 10, for aesthetics, or for any other purpose. Further seen in FIG. 2 is that in some embodiments the cover 40 might comprise a bulb cover 170, which may form the housing 20 across the top of the light bulbs 100 in the space 60, and stationary cover 180, which may form the housing over the electrical components and similar areas of the nail lamp 10, as is described in greater detail below. In an embodiment the bulb cover 170 may be removable from the base 30 and the stationary cover 180, so as to facilitate easier replacement of the light bulbs 100. The bulb cover 170, the stationary cover 180, and the base 30 may be coupled together by any suitable mechanism, including but not limited to being connected via latches, threaded fasteners, clips, or so on. In an embodiment, user or operator serviceable parts may be more easily reached than non-serviceable parts. For example, in an embodiment the bulb cover 170 may be relatively easily removable (i.e. being coupled to the base 30 by quick release clips or latches), so that the user or operator may replace the light bulbs 100, while the stationary cover 180 may be relatively more difficult to remove (i.e. being coupled to the base 30 by threaded fasteners, one way latches, or so on). In FIG. 3, the side view of FIG. 2 is repeated, with the bulb cover 170 removed, such that the light bulbs 100 are visible. As shown in the illustrated embodiment, the bulb cover 170 may be removable from the stationary cover 180, which itself may be attached to the base 30. In the illustrated embodiment, a plurality of clip receptacles 185 may be formed in the stationary cover 180, so as to receive quick release clips on the bulb cover 170, providing quick release of the bulb cover 170 from the stationary cover 180. Although the positioning and orientation of the light bulbs 100 are described in greater detail below, the view of FIG. 3 also illustrates that in an embodiment the side light bulbs 110 (of which only the left side light bulb 110*a* is visible in the view of FIG. 3) may extend further towards the front of nail lamp 10 than the top light bulbs 105 (of which only the top left light bulb 105*a* is visible in the view of FIG. 3). This extension of the side light bulbs 110 is more clearly seen in the top view of FIG. 4, which further shows additional clip receptacles 185, as well as top right light bulb 105*b* and right side light bulb 110*b*.

Figure 5:
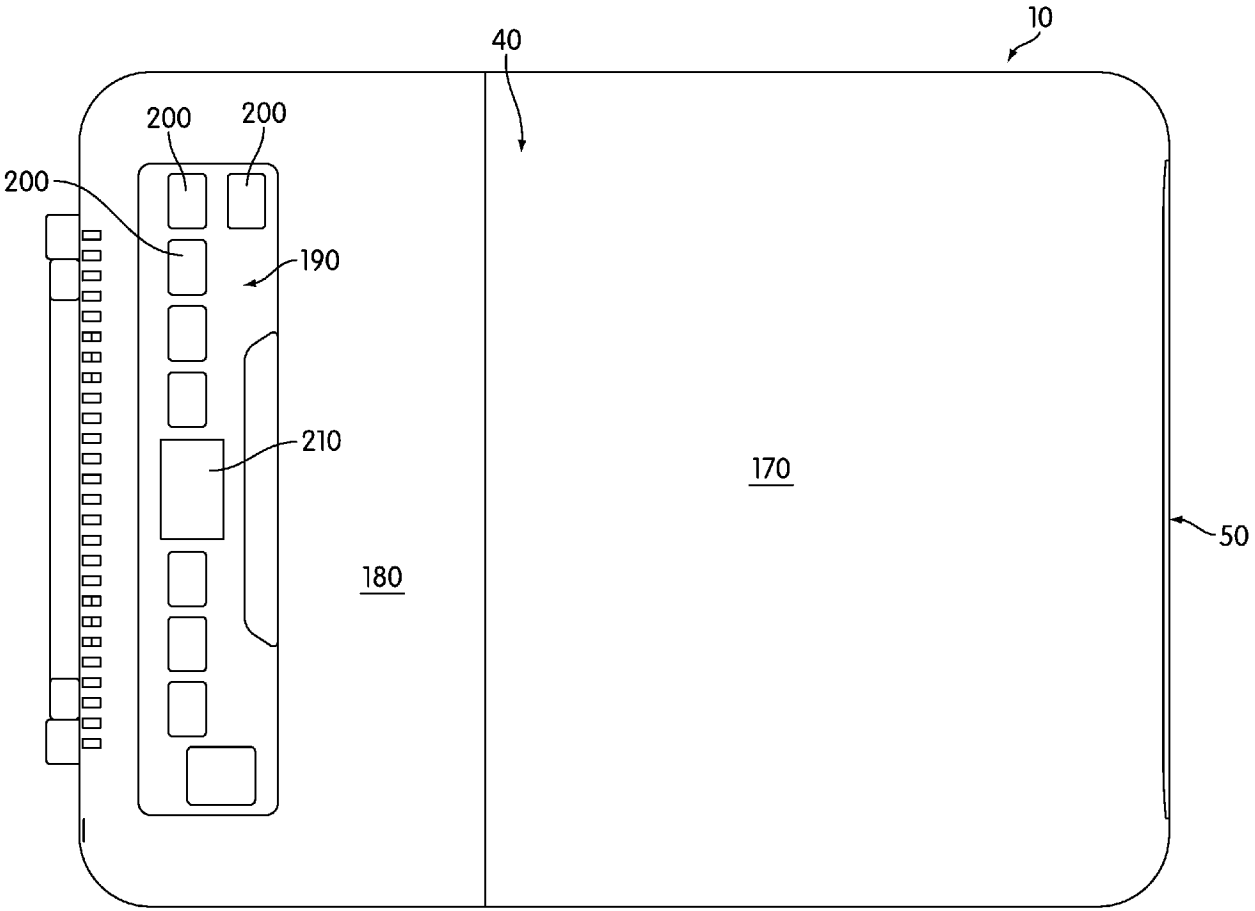
FIG. 5 is a top view of the lamp of FIG. 1.

In FIG. 5, another top view of the nail lamp 10 is depicted, showing the top of the cover 40 with the bulb cover 170 replaced. As seen, in the illustrated embodiment the bulb cover 170 may extend across the nail lamp 10, joining the stationary cover 180 (i.e. at the back wall 120 of the space 60) so that the space 60 has sufficient depth to receive the digits of the hands or feet of the user. In an embodiment, the nail lamp 10 may provide for programmatic or other timing control of the operation of some or all of the light bulbs 100. In the illustrated embodiment, this control may be provided through a control panel 190, which may be configured to allow a user or operator to input controlling parameters of the lamp. For example, through the control panel 190, a user or operator can turn on or off some or all of the light bulbs 100 of the nail lamp 10. In various embodiments, the light bulbs 100 may be controlled individually, or they may be controlled at the same time. In some embodiments the user or operator may also utilize the control panel 190 to increase or decrease the light intensity of one or more of the light bulbs 100. The control panel 190 may be of any construction or configuration, including in the illustrated embodiment containing a plurality of buttons 200 and a display 210 positioned on the housing 20. In other embodiments, the control panel 190 may comprise a touch screen, or other interface. In yet other embodiments, however, the nail lamp 10 may be simplified and lack programmatic control of the light bulbs 100. In such embodiments, a mere power-switch may be provided to supply power to the light bulbs 100. The control panel 190 may incorporate a timer that is designed to keep the bulbs 100 on for a predetermined amount of time (e.g., an amount of time sufficient to cure the gel or acrylic).

Although in the illustrated embodiment the control panel 190 is provided on the top of the stationary cover 180, in other embodiments the control panel 190 may be provided elsewhere, including on other portions of the housing 20, on a separate control unit that is wired or wirelessly connected to the nail lamp 10, or so on. Also, while in the illustrated embodiment the control panel 190 is directed away from the entry aperture 50, configured such that an operator of the nail lamp 10 may face a user of the nail lamp 10, with the nail lamp 10 positioned therebetween, in other embodiments the control panel 190 may face the user of the nail lamp 10, such that the user may control the nail lamp 10 with a free hand, or may program the operation of the nail lamp 10 prior to applying the curable gel or acrylic. In an embodiment, the plurality of buttons 200 may be raised or otherwise configured such that the user does not smear or otherwise disturb gel or acrylic on a hand digit when operating the buttons 200.

Figure 6:
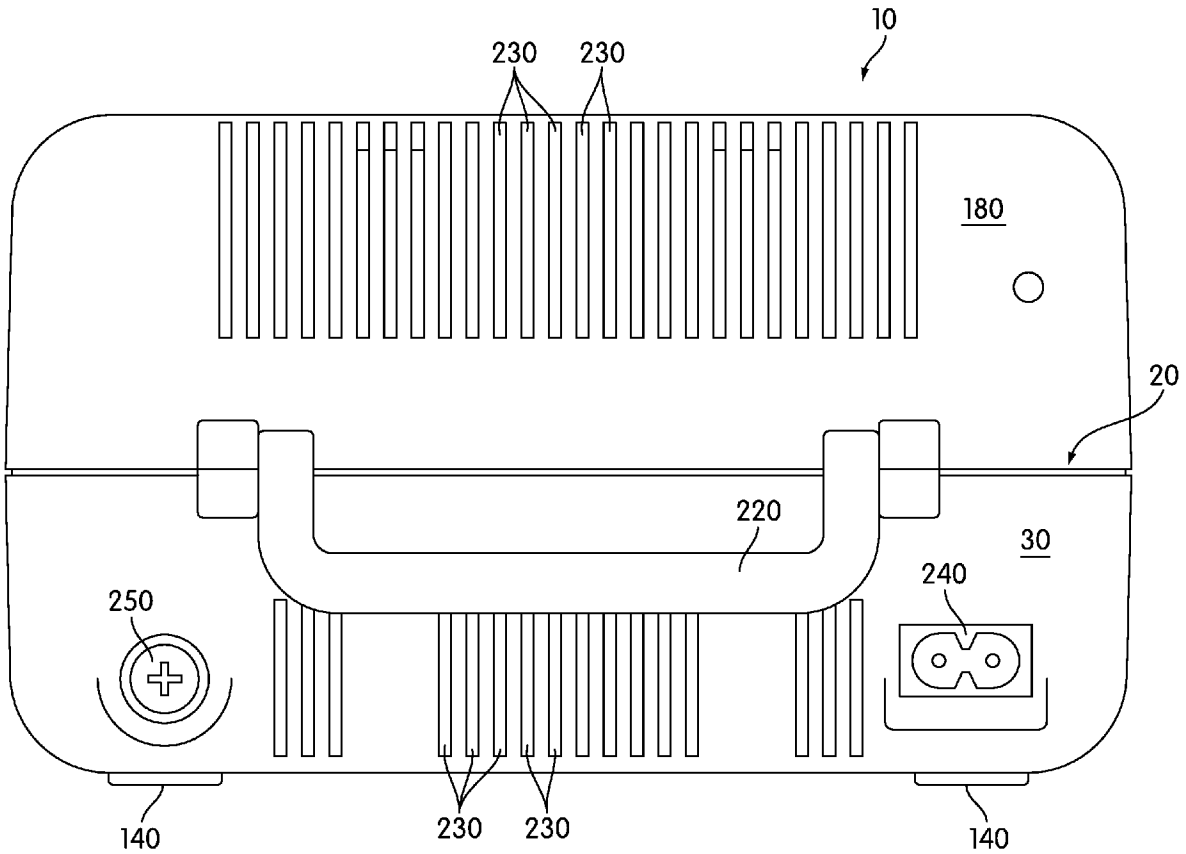
FIG. 6 is a rear view of the lamp of FIG. 1.

FIG. 6 depicts a rear view of the nail lamp 10, (i.e. the side opposite the view of FIG. 1). As shown, the rear of the housing 20 may include a handle 220, which may provide for ease of transport for the nail lamp 10. The positioning of the handle 220 may vary across embodiments, and in some embodiments may be on the side of the nail lamp 10, underneath the entry aperture 50, or so on. In some embodiments, including the illustrated embodiment, the handle 220 may be positioned to join the stationary cover 180 and the base 30. In other embodiments, the handle 220 may be positioned solely on one element of the housing 20. In some embodiments, multiple handles 220 may be provided, so as to facilitate multi-handed transportation of the nail lamp 10. Although in the illustrated embodiment the handle 220 is configured to pivot with respect to the nail lamp 10, in other embodiments the handle 220 may be at a fixed angle with relation to the housing 20, or may be integrally molded into the housing 20.

Also shown on the rear of the illustrated embodiment of the nail lamp 10 are a plurality of air vents 230. Although in the illustrated embodiment the air vents 230 are integrally molded into the housing 20, in other embodiments the air vents 230 may be formed on a separate body that is mountable to the housing 20. Also, while the air vents 230 are illustrated as on the rear of the nail lamp 10, in other embodiments the air vents 230 may be provided elsewhere in the housing 20. In an embodiment, the positioning of the air vents 230 may be configured to correspond to the positioning of the fan 150. In an embodiment, the air vents 230 are provided such that the fan 150 may move air through electrical components under the stationary cover 180, so as to simultaneously cool the electrical components and the space 60.

Further provided on the rear of the illustrated embodiment of the housing 20 are an electrical inlet 240 and an electrical safety 250. The electrical inlet 240 may be of any construction or configuration, including in an embodiment, a power cable configured to plug into a power outlet. In the illustrated embodiment, the electrical inlet is a two-prong inlet configured to couple to a removable power cable. In various embodiments, the electrical inlet 240 may be configured for either AC or DC inputs. In some embodiments, the electrical inlet 240 may be coupled with or replaced by a battery compartment, so that the nail lamp 10 can be powered by one or more batteries, instead of being powered by electricity from an electrical outlet. The electrical safety 250 may be of any suitable construction or configuration capable of preventing electrical faults or other harm to the nail lamp 10 or the user or operator thereof, including but not limited to a circuit breaker switch, a ground fault interrupt switch, or a fuse port to receive and replace electrical fuses.

Figure 7:
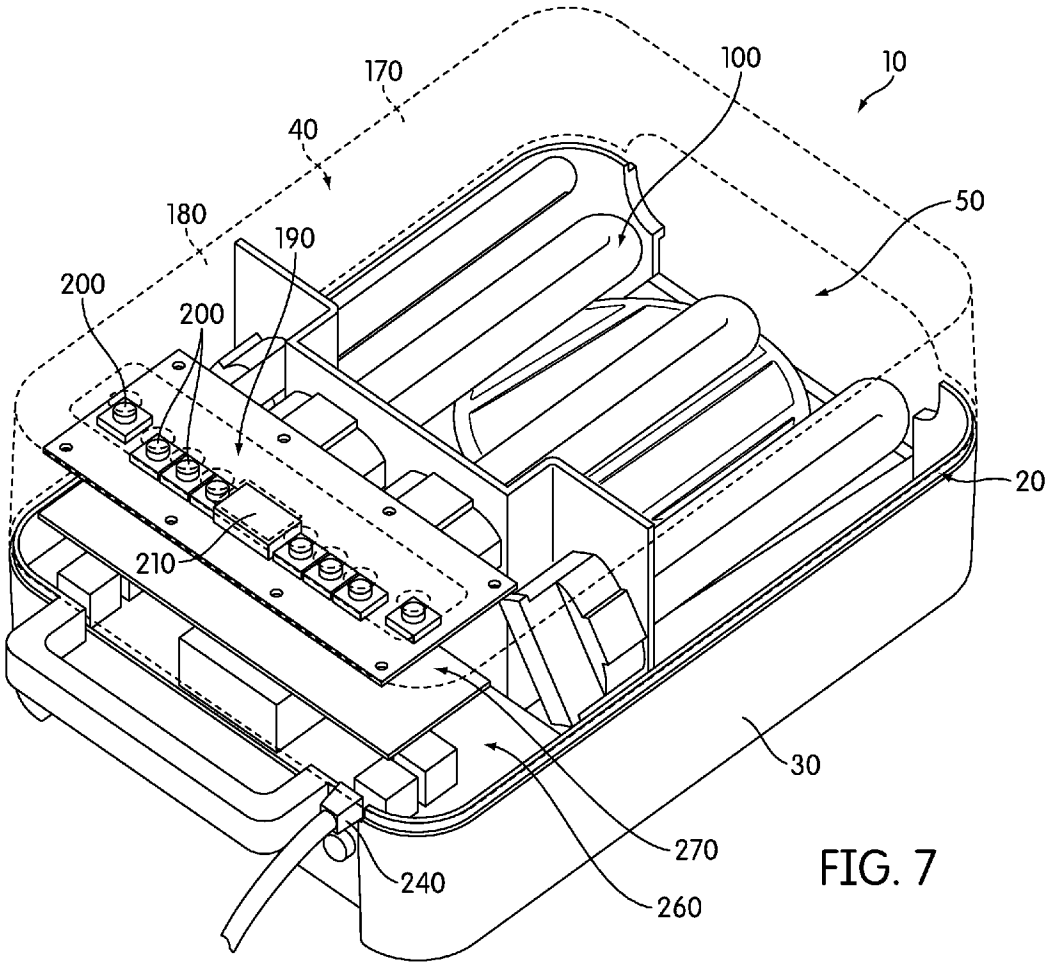
FIG. 7 is a partial top, rear perspective view of the lamp of FIG. 1, with a transparent top of the housing.

FIG. 7 depicts a partial rear top perspective view of an embodiment of the nail lamp 10, wherein the cover 40 is depicted as transparent so as to view the mounting of the control panel 190 thereon, and its electrical connection with the electrical inlet 240. As shown, in the illustrated embodiment, the electrical inlet 240 is configured to receive AC electrical power from the attached power cable. Inside the portion of the base 30 that is covered by the stationary cover 180 are electrical components configured to power the light bulbs 100 and the control panel 190. An AC/DC converter 260 is provided, and configured to convert at least some of the AC power to direct current, so as to provide DC current to the control panel 190. Also shown, between the control panel 190 and the AC/DC converter 260, is a relay panel 270 which may respond to signals provided by the control panel 190, opening and closing relays so as to adjust the operating state of each of the light bulbs 100.

Figure 8:
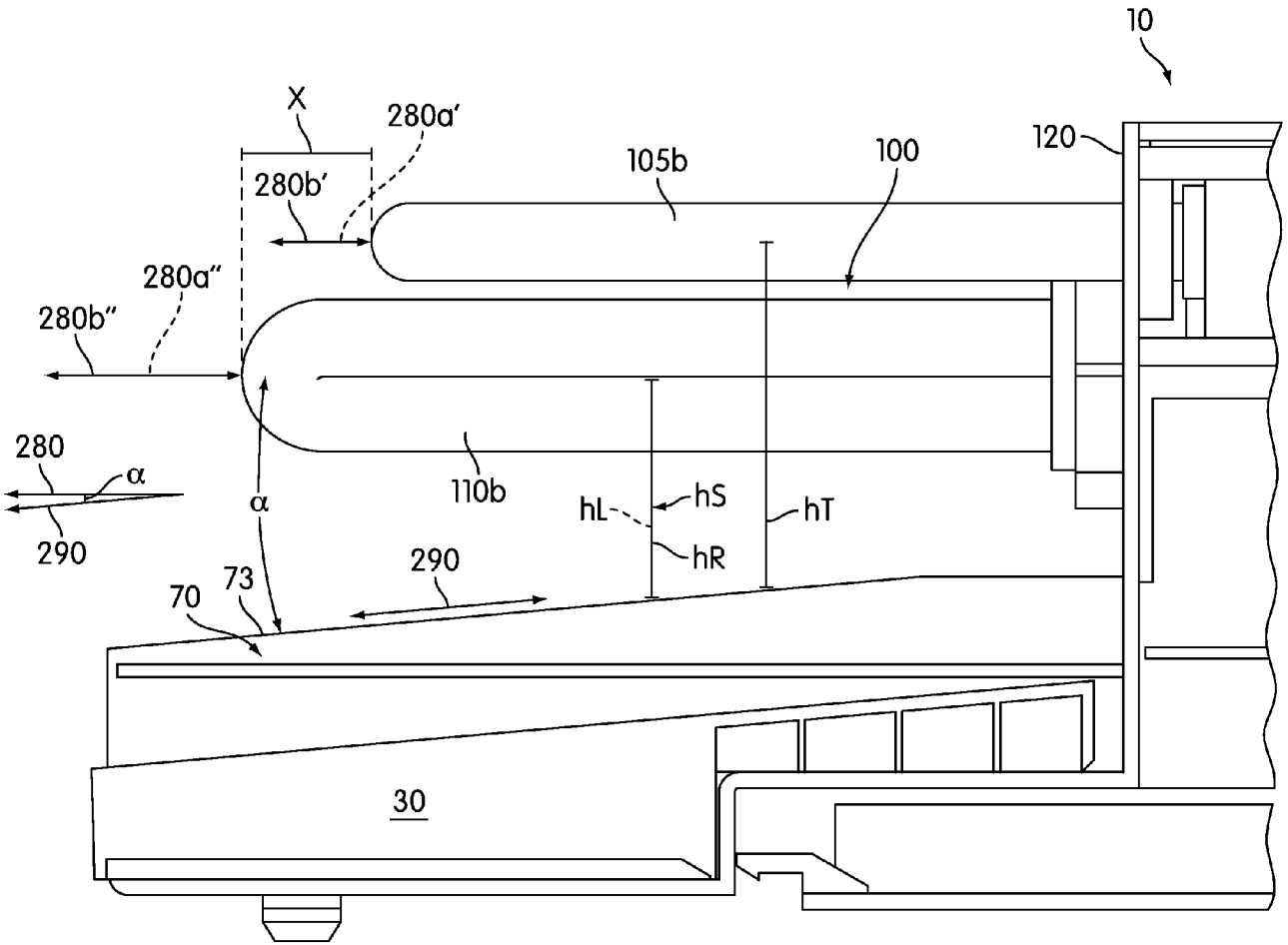
FIG. 8 is a partial right side view of the UV lamp of FIG. 1, showing a positioning of the light sources relative to a platform therein.
Figure 9:
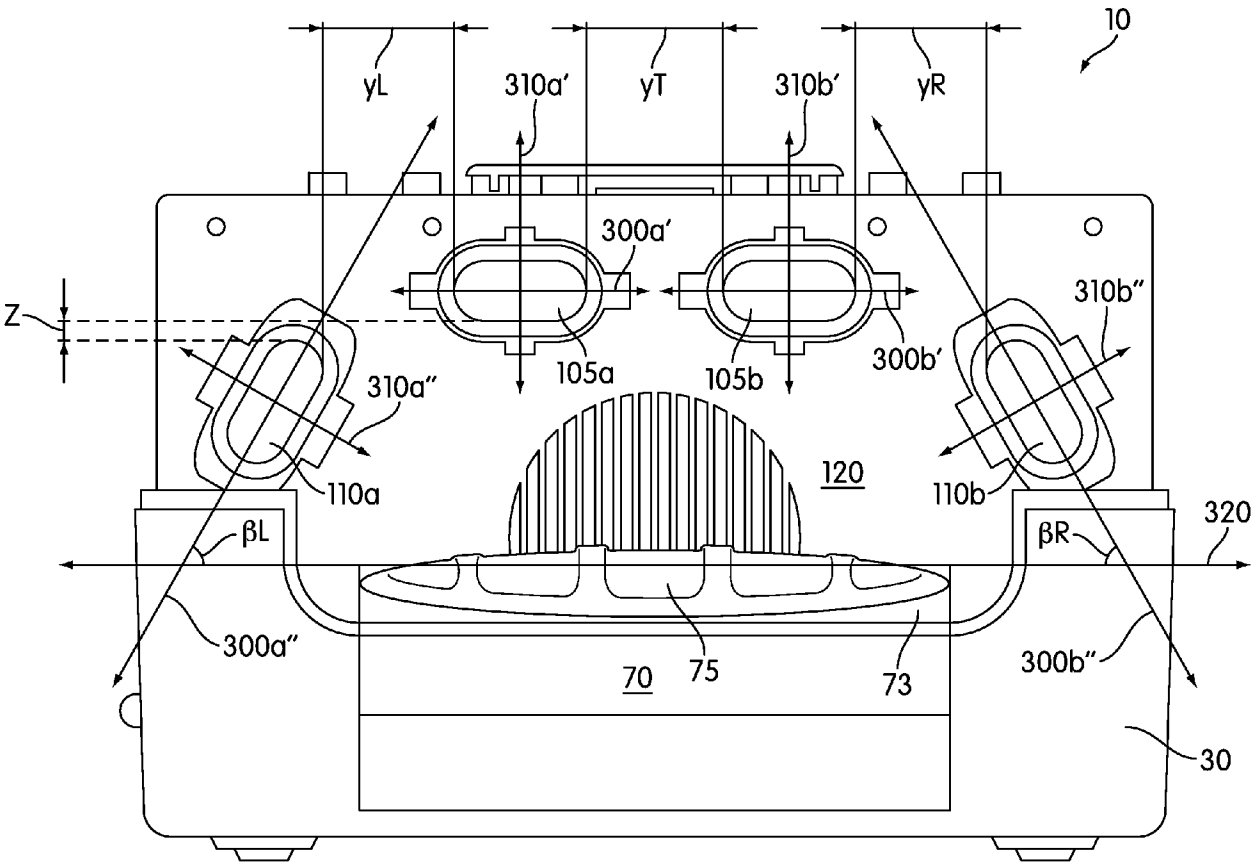
FIG. 9 is a front view of the lamp of FIG. 1, with the cover removed.

From FIGS. 8 and 9, the orientation of the light bulbs 100 relative to the support platform 70 and to each other may be appreciated. In some embodiments, the orientation of the light bulbs 100 in relation to the support platform 70 may be configured to increase the uniformity of light flux on the nails of the digits of the hand or foot of the user over conventional nail lamps. In FIG. 8, a partial right side view of the nail lamp 10 is provided with the bulb cover 170 removed. As shown, the extension of the light bulbs 100 may be along associated longitudinal axes 280 for each of the light bulbs 100. In the embodiment of FIG. 8, top right light bulb 105*b* extends along a longitudinal axis 280*b*', while the right side light bulb 110*b* extends along a longitudinal axis 280*b*". Although obscured in FIG. 8, top left light bulb 105*a* extends along a longitudinal axis 280*a*', while the left side light bulb 110*a* extends along a longitudinal axis 280*a*". In an embodiment, each of the longitudinal axes 280*a*', 280*a*", 280*b*', and 280*b*" are generally parallel to one another, and may be identified collectively as the longitudinal axes 280. As used herein, the term, unless otherwise specifically stated, the term "generally parallel" means within 5 degrees of being parallel.

In an embodiment, although the top light bulbs 105 and the side light bulbs 110 are shown to be of the same construction, and have the same length, their mounting in the nail lamp 10 may differ. In the illustrated embodiment, while the top light bulbs 105 are mounted such that light producing portions of the top light bulbs 105 extend directly from the back wall 120, the light producing portions of the side light bulbs 110 are mounted spaced from the back wall 120, such that they extend closer to the front of the nail lamp 10, where the entry aperture 50 would be formed, by a separation x, as shown in FIG. 8. In an embodiment, the separation x may be measured along the longitudinal axes 280. In an embodiment, the measurement of the separation x may be configured to enhance the light flux received by the outer nails of the hand (i.e. the pinky nail and the thumb nail) or foot (i.e. the big toe nail and the little toe nail) of the user of the nail lamp 10, as such nails generally would not extend as far into the aperture 50 as the intermediate nails.

In the illustrated embodiment, the separation x is approximately the same between the top left light bulb 105*a* and left side light bulb 110*a*, and between the top right light bulb 105*b* and the right side light bulb 110*b*. In such embodiments, the nail lamp 10 may be configured so that the side light bulbs 110 optimize the light flux at a location corresponding to either of the outer nails of the hand or foot, or at a location averaged between both the outer nails of a hand or foot, such that the nail lamp 10 is configured for ambidextrous use. In an embodiment, the separation x measures between 0 mm and 40 mm. In an embodiment, the separation x measures greater than 10 mm. In an embodiment, the measurement the separation x is approximately 20 mm.

Figure 4:
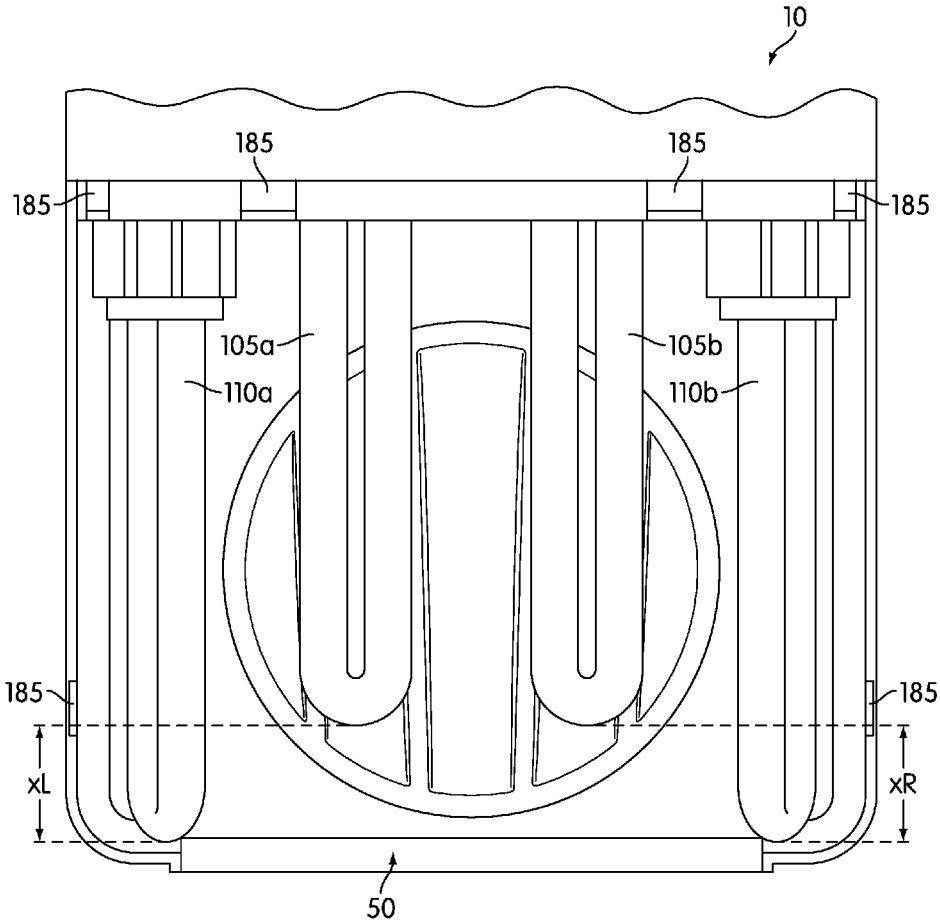
FIG. 4 is a partial top view of the lamp of FIG. 1, with a cover removed.

In other embodiments, the separation x may differ between the top left light bulb 105*a* and left side light bulb 110*a*, and between the top right light bulb 105*b* and the right side light bulb 110*b*. In an embodiment, the nail lamp 10 may be configured to optimize the light flux on the nails of the left hand or foot, or the right hand or foot, of a user. In such embodiments, as shown in FIG. 4, a separation xL may be measured between the top left light bulb 105*a* and left side light bulb 110*a*. Likewise a separation xR may be measured between the top right light bulb 105*b* and the right side light bulb 110*b*. In an embodiment, at least one of the separation xL and the separation xR measures between greater than 0 mm and less than approximately 40 mm. In an embodiment, at least one of the separation xL and the separation xR measures greater than 10 mm. In an embodiment, the measurement of one or more of the separation xL and the separation xR is approximately 20 mm. In some embodiments, the separation xL and the separation xR may change. For example, in some embodiments the left side light bulb 110*a* and the right side light bulb 110*b* may be slidably mounted in the nail lamp 10, such that they may move along their longitudinal axes 280. In some such embodiments, the user or operator may select to configure the nail lamp 10 to enhance UV flux uniformity for the left hand or foot or the right hand or foot depending on which hand or foot is to be placed therein. In various embodiments, the slidable mounting may be manually controlled, or may be motorized. In some embodiments, the control of the separation xL or the separation xR by the motorized movement of the left side light bulb 110*a* or the right side light bulb 110*b* may be controlled by the control panel 190.

Although in the illustrated embodiment, the longitudinal axes 280 are generally perpendicular to the back wall 120 that supports the light bulbs 100, in other embodiments this angle may differ. Likewise, while in the illustrated embodiment the direction of the longitudinal axes 280 are generally parallel to the support surface supporting nail lamp 10, in other embodiments this angle for each of the longitudinal axes 280 may differ. The embodiment of FIG. 8 also illustrates that the top surface 73 of the support platform 70 extends along a platform axis 290 (i.e. a front-to-back axis). An angle α is formed between the longitudinal axes 280 of the light bulbs 100, and the platform axis 290 of the top surface 73 of the support platform 70. Although in the illustrated embodiment the angle α is formed by a slope in the support platform 70, in other embodiments the angle α may be formed by the angle at which the light bulbs 100 are mounted to the housing 20 (i.e. at the back wall 120), the angle that the back wall 120 forms with the remainder of the housing 20, or so on. In some embodiments, some or all of light bulbs 100 may have their own distinct angle α. For instance, the angle α for the top light bulbs 105 may differ from the angle α for the side light bulbs 110. Likewise in some embodiments the angle α may be different for one or more of the top left light bulb 105*a*, the top right light bulb 105*b*, the left side light bulb 110*a*, and the right side light bulb 110*b*. In some embodiments, the angle α can be greater than 0°. For example, in an embodiment, the angle α may be greater than or equal to about 3° but less than or equal to about 15°. In an embodiment, the angle α may be greater than or equal to about 5° but less than or equal to about 10°. In an embodiment, the angle α may be between about 3° and about 7°. In an embodiment, the angle α may be about 5°. In some embodiments wherein the angle α differs between one or more of the top light bulbs 105 and the side light bulbs 110, and wherein the angle α is established by the mounting of the light bulbs 100, the separation x described above may comprise a horizontal vector component of the longitudinal axes 280.

Also appreciable in FIG. 8 is that the top light bulbs 105 may extend a different height h above the top surface 73 of the support platform 70 than the side light bulbs 110. To account for the slope of the top surface 73 at the angle α with respect to the extension of the light bulbs 100 on parallel longitudinal axes 270, and to account for the separation x between the top light bulbs 105 and the side light bulbs 110, the height h for each of the light bulbs 100 may be measured as the distance between the geometric center point of the light-producing portion of the light bulbs 110 and a plane defined by the top surface 73 of the support platform 70. As shown in the Figure, in an embodiment the geometric center point of a light-producing portion of the top light bulbs 105 are disposed a vertical distance hT above the top surface 73. Likewise, the geometric center point of light-producing portions of the side light bulbs 110 are disposed a vertical distance hS above the plane of the top surface 73.

In some embodiments, the geometric center points of some or all of the top light bulbs 105 and the side light bulbs 110 may differ. For example, in an embodiment the light-producing portion of the left side light bulb 110*a* is disposed a vertical distance hL above the plane of the top surface 73. Likewise, in an embodiment the light-producing portion of the right side light bulb 110*b* is disposed a vertical distance hR above the plane of the top surface 73. In an embodiment, the vertical distance hT is between about 30 mm and 40 mm. In an embodiment, the vertical distance hT is about 37 mm. In an embodiment, at least one of the vertical distance hL and the vertical distance hR is between about 20 mm and 30 mm. For example, in an embodiment at least one of the vertical distance hL and the vertical distance hR is about 27 mm. In one embodiment, at least one of the difference between the vertical distance hT and the vertical distance hL, and the difference between the vertical distance hT and the vertical distance hR, may be between about 0.5 and about 30 mm. For example, at least one of (hT-hL) and (hT-hR) may be between about 1 and about 26 mm. In some such embodiments, at least one of (hT-hL) and (hT-hR) may be between about 1 and about 20 mm. In a more particular embodiment, at least one of (hT-hL) and (hT-hR) may be between about 5 and about 15 mm. In a still more particular embodiment, at least one of (hT-hL) and (hT-hR) may be between about 8 and about 10 mm. In embodiments such as that illustrated in FIG. 8, wherein hL and hR are equal to one another, the vertical distance hS is equal to both the vertical distance hL and the vertical distance hR.

It is seen in FIG. 9 that each of the side light bulbs 110 may be angled with respect to the top surface 73. From this view, which is along the longitudinal axes 280, a lateral axis 300 and a depth axis 310 for each light bulb 100 may be appreciated. In the illustrated embodiment, the light bulbs 100 are elongated such that they are wider across their lateral axes 300 than across their depth axes 310 (though the bulbs 100 are elongated much more along their longitudinal axes 280 than along either of their other axes 300, 310). To distinguish the axes for individual ones of the light bulbs 100 in FIG. 9, the designator "a" indicates positioning on the left side of the nail lamp 10, while the designator "b" indicates positioning on the right side of the nail lamp 10. Likewise, the designator "'" designates being associated with the top light bulbs 105, while the designator "'" designates being associated with the side light bulbs 110. As shown, the top light bulbs 105 are mounted in the nail lamp 10 such that their respective lateral axes 300' are generally parallel to the plane of the top surface 73 (or a side-to-side axis 320 defined by the top surface 73). Such an orientation may generally be selected such that the wider edge of the top light bulbs 105 are substantially oriented to face the respective nails of the index, middle, and ring fingers. Conversely, the side light bulbs 110 are angled with respect to the plane of the top surface 73 and the side-to-side axis 320, such that their respective lateral axes 300" form the angle β therewith, as facing the support platform 70. In an embodiment, the angle β is formed by rotating the orientation of the light bulbs 100 clockwise or counterclockwise about their longitudinal axes 280. In an embodiment, the angle β may be selected such that the wider edges of the side light bulbs 110 are generally oriented to face the respective thumb nails of a user of the nail lamp 10. In an embodiment, the angle β may be greater than or equal to about 45°, but smaller than or equal to about 90°. In an embodiment, the angle β may be greater than or equal to about 50° but smaller than or equal to about 70°. In a more particular embodiment, the angle β may be approximately 60°. In an embodiment, depending on whether the left or right hand is placed in the nail lamp 10, while the thumb faces one of the left side light bulb 110*a* and the right side light bulb 110*b*, the pinky may generally be proximal to the other of the left side light bulb 110*a* and the right side light bulb 110*b*.

In some embodiments, each of the left side light bulb 110*a* and the right side light bulb 110*b* may form different angles β with respect to the plane of the top surface 73 and the side-to-side axis 320. For example, while one of the side light bulbs 110 is angled to increase flux on the thumb nail, the other may be angled to increase flux on the pinkie nail. In such embodiments, the left side light bulb 110*a* may be at an angle βL, while the right side light bulb 110*b* may be at an angle βR. In the illustrated embodiment, however, the side light bulbs 110 are shown as mirroring each other across the support platform 70, such that the angle βL is equal to the angle βR, and the angles βL and βR may collectively be referred to as angle β.

Also shown in FIG. 9, each of the light bulbs 100 may be spaced from one another as mounted in the nail lamp 10, within the view of the longitudinal axes 280. For example, in the view of FIG. 9 the top light bulbs 105 may be spaced from each other at their closest light-producing portions by a horizontal distance yT. Likewise, the top left light bulb 105*a* and the left side light bulbs 110*b* may be spaced from each other at their closest light-producing portions by a horizontal distance yL. Additionally, the top right light bulb 105*b* may be spaced from the right side light bulb 110*b* at their closest light-producing portions by a horizontal distance yR. In an embodiment, at least one of the distance yR, the distance yL, and the distance yT may be greater than about 10 mm and less than about 35 mm. In a more particular embodiment, at least one of the distance yR, the distance yL, and the distance yT may be between about 15 mm and about 30 mm. In a further still particular embodiment, at least one of the distance yR, the distance yL, and the distance yT may be between about 18 mm and about 26 mm, such as about 22 mm, for example. While in some embodiments, the distance yR, the distance yL, and the distance yT may be the same, in other embodiments the distances may be different from one another. In an embodiment, the spacer platform 75 may space the nails on the index, middle, and ring fingers to substantially squarely face the at least part of one or more of the top left light bulb 105*a* and the top right light bulb 105*b*. In some embodiments the light bulbs 100 may be spaced from each other by a vertical distance z. In the illustrated embodiment, while the top light bulbs 105 are arranged on the same horizontal plane, the light-producing portions of the top light bulbs 105 are spaced from the light-producing portions of both of the side light bulbs 110 by the vertical distance z. In some embodiments, the vertical distance z may differ for either one of the top light bulbs 105 or the side light bulbs 110, which may affect the measurements h above.

In operating the nail lamp 10, the user may apply a light-curable nail product to the nails of the digits of the user's hand(s), foot, or feet. In some embodiments, the light-curable nail product may be applied by another to the user's nails. In an embodiment, all five nails of all five digits of a user's hand or foot, having an uncured light-curable nail product applied thereon, may be received in the space 60 between the support platform 70 and the plurality of light bulbs 100. The nail lamp 10 may be turned on by the user or an operator via the control panel 190, so that the light-curable nail product on all five said nails are simultaneously exposed to light from the plurality of light bulbs 100. As a result, the nail product on all five nails can be exposed to the light and thereafter cured. The control panel 190 may be configured to adjust the timing of the operation of each of the light bulbs 100, the intensity of the light bulbs 100, and/or the on/off status of each of the light bulbs 100. For example, in some embodiments, the nail lamp 10 may only provide light to one of the side light bulbs 110, such as the left side light bulb 110*a* facing the thumb of the right hand, or the right side light bulb 110*b* facing the thumb of the left hand.

As indicated above, the nail lamp 10 may be configured to allow exposure of all of the nails placed therein to be subject to a fairly uniform light flux from the light bulbs 100. Depending on the type of light bulb 100, the flux can be, for example, a UV flux from the UV light. Accordingly, in one embodiment, UV-curable nail product on the five nails (e.g., thumb, index, middle, ring, and pinky fingers of a hand) can be exposed to a substantially uniform amount of UV flux from UV light bulbs 100. The term "substantially uniform flux" refers to fluxes with a difference of less than 25% in flux intensity. The deviation in flux between the different nails may be less than 25%, 15%, 10%, 5%, 2%, 1%, and/or 0.5% in flux intensity.

In some embodiments, the nail lamp 10 may be configured to provide similar efficacy regardless of whether the nails to be cured are on the hands or feet of the user, and regardless of whether it is the right hand or foot, or the left hand or foot inserted into the space 60. For example, the results for the right and left and for the finger and toe nails can be at least about 80% equal to each other, such as at least 90% equal to each other, such as at least 95% equal to each other, such as at least 99% equal to each other. In some embodiments, replacement of the support platform 70 for the hands with the support platform 70 for the feet may facilitate this similar efficacy for a foot. In some embodiments, the support platform 70 for a foot may be about at least about 5 mm farther away from the top light bulbs 105 than a hand support platform 70. In, some embodiments, the support platform 70 for the feet may be at least about 10 mm, at least about 20 mm, or at least about 30 mm, further away from the top light bulbs 105 than the hand support platform 70.

Figure 10:
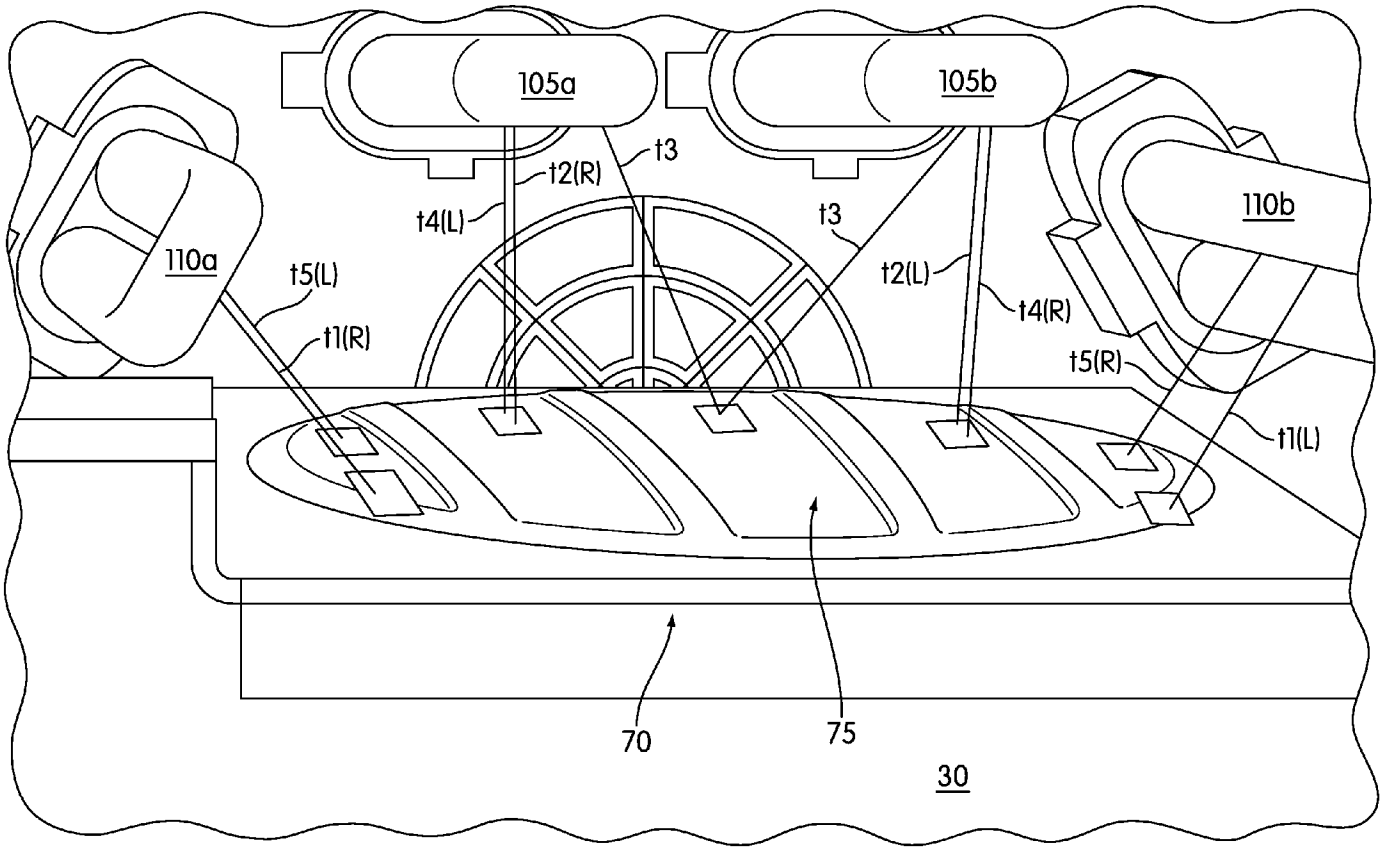
FIG. 10 is a partial front perspective view of the lamp of FIG. 1, with the cover removed.

As shown in FIG. 10, in an embodiment the relationship between each of the light bulbs 100 and the support platform 70 may be configured so as to normalize the distance between the light bulbs 100 and the nails of digits placed in the nail lamp 10. For example, the distance between the nail of each digit and the closest one of the side light bulbs 110 or top light bulbs 105 can be defined as t. In one embodiment where a hand is placed in the nail lamp 10, and the digits are the thumb, index, middle, ring, and pinky fingers of the hand, the distance t1 can denote the distance between a nail on the thumb and a proximal one of the side light bulbs 110. The distance t2 can be measured as that between a nail on the index finger and a closest one of the top light bulbs 105. The distance t3 may be the distance between a nail on the middle finger and a closest one of the top light bulbs 105, or the average distance to multiple ones of the top light bulbs 105. The distance t4 may be the distance between a nail on the ring finger and the closest one of the top light bulbs 105. In the illustrated embodiment, (R) designates the general distances t1-t4 between the nails of the right hand or foot when positioned on the support platform 70, and separated from the other nails by the spacer platform 75. The distance t5(R) is also provided, and measures the distance between the right pinkie nail or the nail of the little toe on the right foot and a closest one of the side light bulbs 110. The indicator (L) designates the general distances t1-t4 between the nails of the left hand or foot when positioned on the support platform 70, and separated from the other nails by the spacer platform 75. Likewise, the distance t5(L) is also provided, and measures the distance between the left pinkie nail or the nail of the little toe of the left foot and a closest one of the side light bulbs 110. In the illustrated embodiment, wherein the light bulbs 100 are formed from a bent tube, the distances t1-t5 may be measured to a closest light emitting area of the light bulbs 100. Likewise, in embodiments wherein the light bulbs 100 comprise an array of LEDs, the distances t1-t5 may be measured to the closest area on any of the LEDs in the array. As indicated above, in various embodiments, depending on the angles $\alpha$ and $\beta$, and the values of x, h, and y, the distances t1-t5 can be the same or different. In one embodiment, at least some of the distances t1-t5 can be within 25%, 15%, 10%, and/or 5% of each other.

The foregoing illustrated embodiments are provided to illustrate the structural and functional principles of the present invention and are not intended to be limiting. To the contrary, the principles of the present invention are intended to encompass any and all changes, alterations and/or substitutions within the spirit and scope of the following claims.

What is claimed:

1. A lamp comprising:

a housing;

an upwardly facing platform supported by the housing;

a plurality of light sources supported by the housing, the plurality of light sources including a left light source disposed on a left side of the lamp, a right light source disposed on a right side of the lamp, and a first top light source disposed at least partially above the platform, wherein at least one of the left and right sources extends closer to a front of the lamp than the first top light source does; and a spacing between the platform and the plurality of light sources, the space being sized and positioned to simultaneously receive therein five nails of all five digits of a hand or foot of a user so as to expose each of the five nails to at least one of the plurality of light sources;

wherein a front of the left light source extends forwardly of a front of the first top light source by a distance xL, a front of the right light source extends forwardly of a front of the first top light source by a distance xR, and at least one of the distances xL and xR is at least 10 mm; and wherein one or more of the left light source and the right light source is slidably supported by slidable supports in the housing so as to permit variability in the distance xL or the distance xR respectively.

2. The lamp of claim 1, wherein the slidable supports for the one or more of the left light source and the right light source are motorized.

* * * * *